US006908284B2

(12) United States Patent
Adrian

(10) Patent No.: US 6,908,284 B2
(45) Date of Patent: Jun. 21, 2005

(54) FAN ATTACHMENT WITH DYNAMIC OUT-OF-BALANCE EQUALIZATION

(75) Inventor: Ludger Adrian, Buehl (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 10/416,665

(22) PCT Filed: Aug. 6, 2002

(86) PCT No.: PCT/DE02/02881

§ 371 (c)(1),
(2), (4) Date: May 13, 2003

(87) PCT Pub. No.: WO03/040570

PCT Pub. Date: May 15, 2003

(65) Prior Publication Data

US 2004/0013517 A1 Jan. 22, 2004

(30) Foreign Application Priority Data

Oct. 30, 2001 (DE) ..... 101 53 412

(51) Int. Cl.[7] ..... F04D 29/20; F16D 3/04

(52) U.S. Cl. ..... 416/134 R; 416/135; 416/144; 416/145; 416/148; 464/87

(58) Field of Search ..... 416/62, 134 R, 416/135, 139, 144, 145, 147, 148, 149, 202, 169 A, 132 A; 464/87, 93, 88

(56) References Cited

U.S. PATENT DOCUMENTS

| | | | | | |
|---|---|---|---|---|---|
| 1,760,619 | A | * | 5/1930 | Woolson | 464/93 |
| 2,702,087 | A | * | 2/1955 | Beier | 416/134 R |
| 3,302,867 | A | | 2/1967 | Roffy | |
| 3,368,835 | A | * | 2/1968 | Hackforth | 464/93 |
| 4,917,573 | A | * | 4/1990 | Sikula, Jr. | 416/134 R |

FOREIGN PATENT DOCUMENTS

| | | | | |
|---|---|---|---|---|
| DE | 91 02 865 | U | 7/1992 | |
| DE | 41 43 383 | A | 2/1994 | |
| DE | 100 58 935 | A | 6/2001 | |
| DE | 199 58 261 | A | 7/2001 | |
| FR | 2 756 021 | A | 5/1990 | |
| FR | 2756021 | A1 * | 5/1998 | F04D/29/32 |
| GB | 1 376 710 | A | 12/1974 | |

* cited by examiner

*Primary Examiner*—Edward K. Look
*Assistant Examiner*—Richard A. Edgar
(74) *Attorney, Agent, or Firm*—Michael J. Striker

(57) ABSTRACT

The invention is based on an axial fan with a hub region (4, 27) for connecting the axial fan with a driven shaft (20) of an electrical drive (21), whereby the axial fan is statically balanced by means of a balancing weight (26). A flexurally soft connection is formed in the hub region (4, 27) between the axial fan (1) and the driven shaft (20) of an electrical drive (21).

20 Claims, 10 Drawing Sheets

FAN ATTACHMENT WITH DYNAMIC OUT-OF-BALANCE EQUALIZATION

BACKGROUND OF THE INVENTION

Due to environmental considerations, great efforts are being made to eliminate sources of noise in motor vehicles to the greatest extent possible. In addition to tires and internal combustion engines, other acoustic sources are add-on components of the internal combustion engine, e.g., engine cooling fans. With acoustic sources of this nature, a general distinction is made between airborne noise vibrations and the occurrence of structure-borne noise. The occurrence of structure-borne noise can be perceived in the form of inertial force-excited vertical vibrations in the steering wheel of a motor vehicle.

PRIOR ART

With engine cooling fans that are common today, a compensation of the static imbalance is usually carried out so that the permissible limit values can be met. In the case of fans, which often have a flat design, a compensation of the dynamic imbalance (couple imbalance) is not possible at all or only at great expense, since the measurement itself causes problems due to the low flat clearance, and it would not be possible to securely attach the correction masses required to compensate the couple imbalance to the labile fan blades. As a result, it is accepted practice for engine cooling fans to be delivered with non-defined dynamic imbalance. Depending on the respective installation situation in the vehicle, the structure-borne noise produced by the dynamic imbalance can result in complaints about vibrations perceived in the passenger compartment. The remaining remedies, such as installing damping elements in the transmission path, or reworking plastic fans in order to reduce their imbalance present upon delivery, are costly and they do not necessarily result in a satisfactory reduction of vibrations.

The inertial forces—static and dynamic imbalances—are caused by inhomogeneous distributions of mass of the rotating rotor/armature assemblies and fans, and by tolerances of form and position relative to the rotation axis of the drive. Tolerances of form and position cause the rotation axis and main axis of inertia to no longer coincide. A parallel displacement between rotation axis and main axis of inertia, e.g., of a cooling fan having a fan wheel mounted on the armature or rotor shaft results in a static imbalance, while a main axis of inertia tilted relative to the rotation axis can produce a centrifugal moment, the effects of which are comparable to a couple imbalance or dynamic imbalance.

ADVANTAGES OF THE INVENTION

The advantages of the means for attaining the object of the invention proposed according to the invention are seen mainly in the fact that a soft connection of the axial fan to the armature or rotor of an electrical drive permits the axial fan to orient itself in the direction of the rotation axis as rotational speed increases. As a result, the disturbance variable, i.e., the imbalance moment, is automatically reduced by the rotation of the axial fan as the rotational speed increases. The influence of tolerances of form of the axial fan wheel drops off substantially with regard to the dynamic centrifugal moment, since a self-orientation of the axial fan wheel with regard to the rotation axis takes place. As a result, tolerances of form and position of the axial fan wheel are automatically compensated as well with regard to the dynamic imbalance.

Since the dynamic imbalance of an axial fan is clearly dominated by the dynamic imbalance of the axial fan wheel, a two-plane imbalance compensation with the armature and rotor of the electrical drive can be foregone. This, in turn, presents an opportunity for substantial savings, since the processing steps required to obtain two-plan imbalance compensation can now be eliminated entirely. The armature balancing can be foregone entirely, if necessary, by limiting the imbalance compensation to a purely static balancing of an axial fan on the axial fan wheel.

Due to the soft embodiment of the hub of the axial fan wheel, and/or the connection point of the axial fan wheel with the armature or the rotor shaft, the installation of additional damping systems that take up precious space can be foregone. The modifications of the hub of the axial fan wheel with regard to increasing flexural softness can also be carried out in simple fashion and very cost-effectively within the framework of reworking of engine cooling fans that have already been delivered.

SUMMARY OF THE DRAWINGS

The invention will be described hereinbelow with reference to drawings.

DESCRIPTION OF THE PREFERRED EMBODIMENTS

Figure 1:
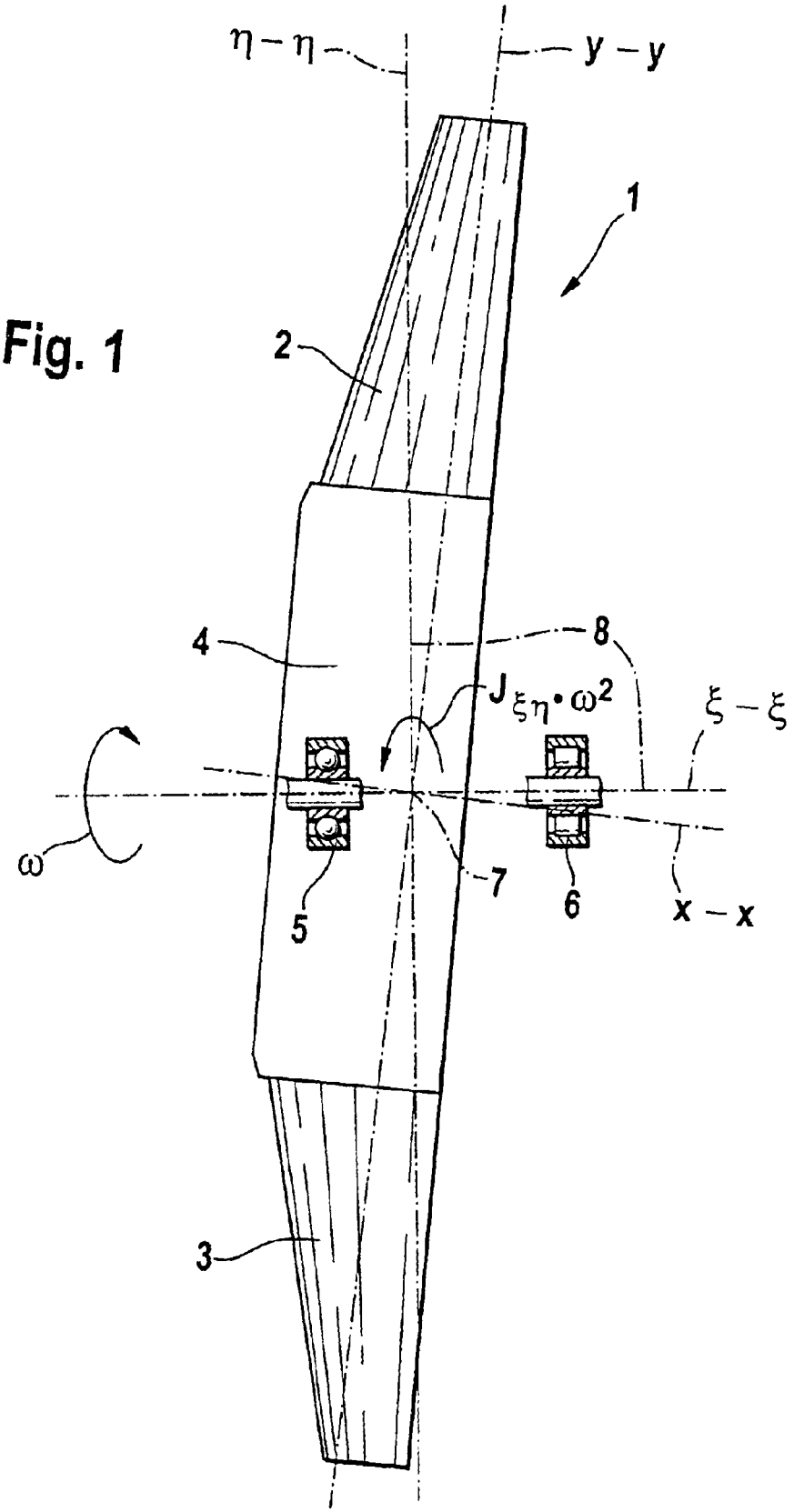
FIG. 1 shows an axial fan wheel, the main axis of inertia of which is tilted relative to the rotation axis.

FIG. 1 shows an axial fan wheel, the main axis of inertia of which is tilted relative to the rotation axis.

An axial fan wheel 1 comprises fan blades 2 and 3 essentially situated on its outer circumferential region, which said fan blades are mounted on the circumference of a hub region 4. An axial fan wheel 1 according to the depiction in FIG. 1 is preferably manufactured as a plastic injection-molded part. An axial fan wheel of this type is supported on an armature or rotor shaft of an electrical drive not shown in FIG. 1, and it is set in rotation via the electrical drive. The axial fan wheel 1 has a main axis of inertia labelled "x—x" in the depiction according to FIG. 1. Another axis of inertia, labelled "y—y", extends at a right angle to said main axis of inertia.

A rotation axis coordinate system 8, characterized by the rotation axis $\xi$—$\xi$ and the axis $\eta$—$\eta$ extending at a right angle thereto, is displaced relative to the aforementioned axes of inertia x—x and y—y. The rotation axis coordinate system 8 is tilted slightly compared to the coordinate system formed by the axes of inertia. The rotation axis ξ—ξ is turnably supported in bearings, one of which is designed as a fixed bearing 5 that absorbs axial and radial forces, and the other bearing 6 of which is designed as a movable bearing capable only of absorbing radial forces and permitting an axial displacement of the rotation axis ξ—ξ of the axial fan wheel 1.

The center of gravity, in which the axes of inertia x—x and y—y of the axial fan wheel 1 intersect, is labelled with reference numeral 7. ω represents the angular velocity at which the axial fan wheel—driven by an electrical drive not shown here—rotates around the rotation axis ξ—ξ.

Figure 2:
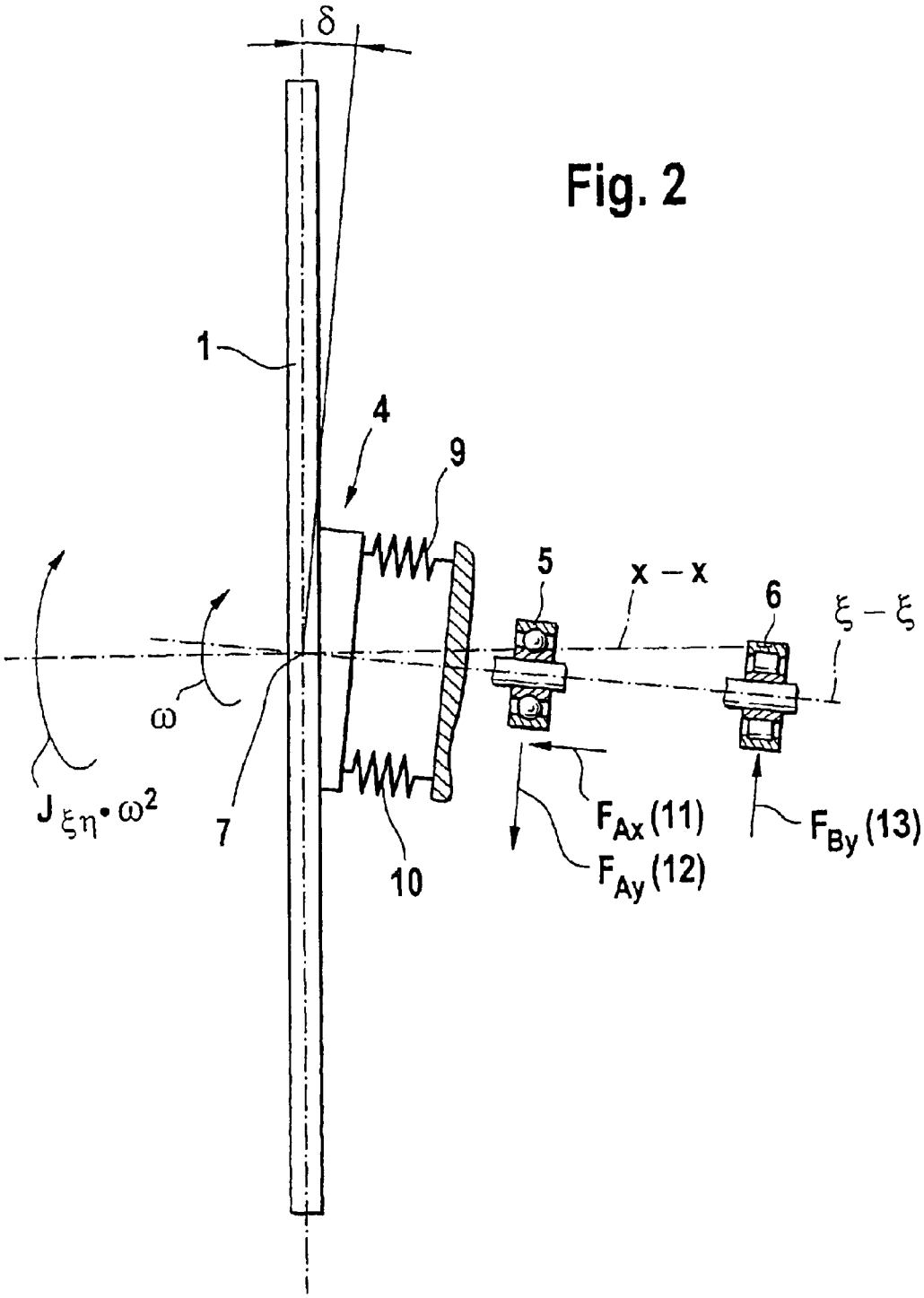
FIG. 2 shows the inclination of the axial fan wheel on a substitute model of the axial fan wheel.

FIG. 2 shows the inclination of an axial fan wheel with reference to a substitute model of an axial fan wheel.

According to the depiction shown as a model in FIG. 2, the axial fan 1 is idealized as a rigid disk, while its region of connection to the rotation axis ξ—ξ is modelled as an axially-acting spring arrangement 9 and 10.

According to the depiction in FIG. 2, the imbalance moment $J_{\xi\eta}\cdot\omega^2$ is directed in such a manner that the fan's main axis of inertia x—x is brought into overlap with the rotation axis ξ—ξ, so that the torque delivered by the electrical drive not shown here can be utilized by the embodiment of the connection of the fan modelled as a rigid disk to its hub region in order to reduce the dynamic imbalance given by the centrifugal moment $J_{\xi\eta}\cdot\omega^2$. In the case of the modelled depiction according to FIG. 2, the rotation axis ξ—ξ is supported in a fixed bearing 5 and in a movable bearing 6.

The axial force $F_{Ax}$ (11) acts on the fixed bearing 5 in the axial direction, and the radial force $F_{Ay}$ (12) acts on the fixed bearing 5 in the radial direction. In contrast, the movable bearing 6 only absorbs forces in the radial direction, characterized by $F_{By}$ (13). The angle between the main axis of inertia x—x of the axial fan wheel 1 and its rotation axis ξ—ξ is labelled with δ.

Figure 3:
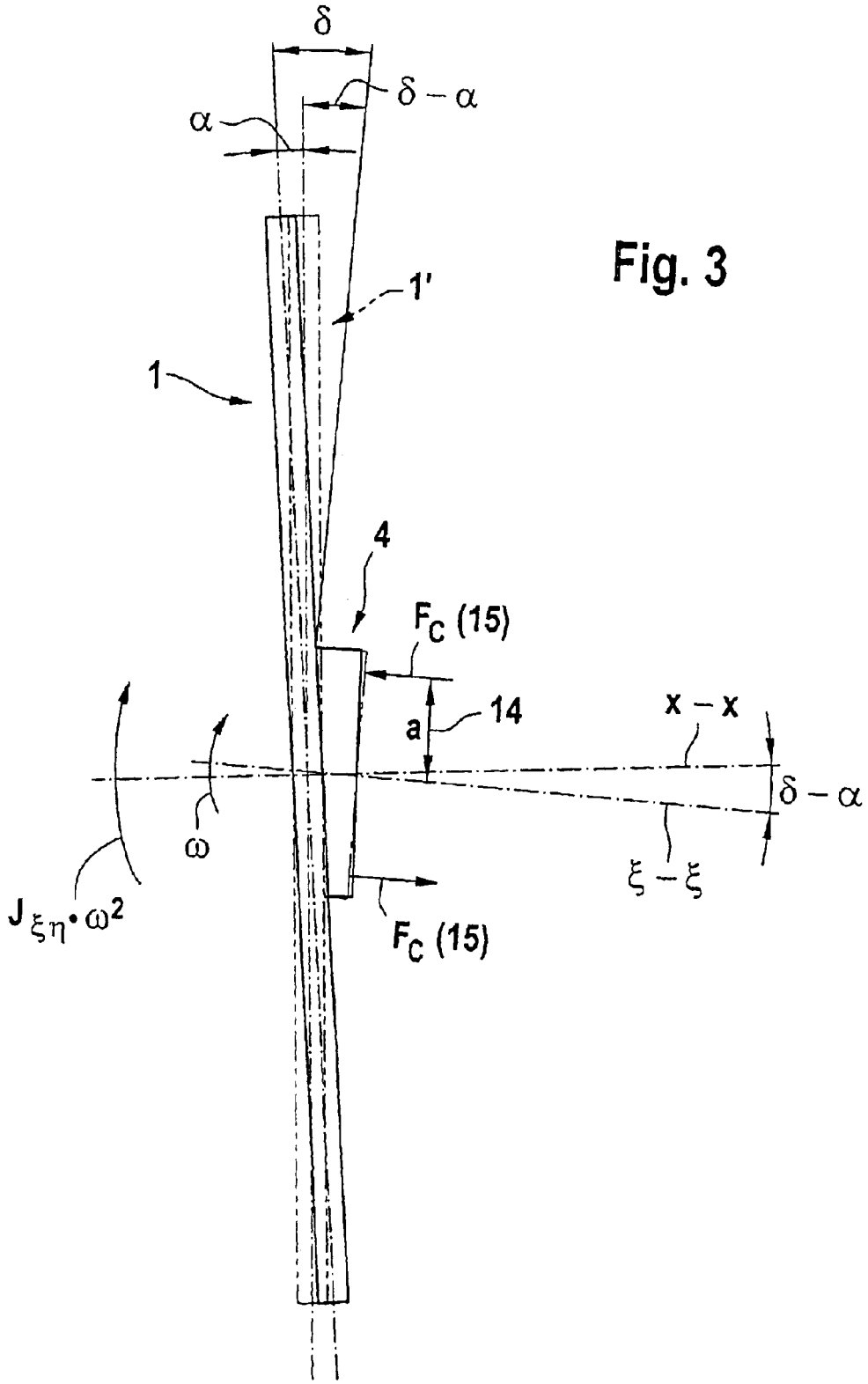
FIG. 3 shows the inclination $\delta$ of the axial fan at rotational speed $\omega=0$.

The inclination δ of the axial fan wheel at rotational speed ω=0 is shown in the depiction according to FIG. 3.

In the case of an axial fan wheel, centrifugal moments produce considerable forces and moments depending on the rotational speed. With a maximum centrifugal moment of 45000 $gmm^2$, for example, the imbalance moment characterized as follows acts on the axial fan wheel 1 at a speed of 2500 rpm:

$$M = J_{\xi\eta}\cdot\omega^2 = 45000\ \text{gmm}^2\cdot\left(\frac{2500\cdot 2\pi}{60}\right)^2 s^{-2} = 3.08\ \text{Nm}$$

According to the depiction shown in FIG. 3, the moment acts in the direction of the arrow on an axis of the axial fan wheel—modelled as a rigid disk—extending at a right angle to the plane of the drawing. As a result of this moment, the axial fan wheel 1 is displaced by the angle α into the position labelled with δ−α and with 1'. As a result, the main axis of inertia x—x of the axial fan wheel 1 moves closer to the position of the rotation axis ξ—ξ, around which the axial fan wheel 1 rotates at the angular velocity ω. Based on the calculation shown hereinabove, it become clear that the re-alignment of the main axis of inertia x—x with the position of the rotation axis ξ—ξ increases as rotational speed increases, since said rotational speed is squared in the moment calculation. This means that, as rotational speed increases, the angle α increases and, as a result, the inclination δ at ω=0 is reduced continually until, in the ideal case, the angle δ−α equals zero. In this case, the main axis of inertia x—x of the axial fan wheel 1 coincides with its rotation axis ξ—ξ.

The forces 15 labelled with $F_c$ act on the hub region 4 of the axial fan wheel 1 modelled as a rigid disk. Said forces act on the rotation axis ξ—ξ of the axial fan wheel 1 around the lever arm a—also labelled with reference numeral 14—and counteract the moment produced by the centrifugal moment $J_{\xi\eta}\cdot\omega^2$. As rotational speed increases, the axial fan wheel 1 is pushed in the direction of the rotation axis ξ—ξ as a result of the centrifugal moment $J_{\xi\eta}\cdot\omega^2$. It follows from this that, when the hub region is designed to be as flexurally soft as possible, that is, with a flexurally soft connection of the hub region 4, 27 of the axial fan wheel 1 with its rotation axis ξ—ξ, the imbalance moment that occurs and that decreases with the rotational speed can be utilized to re-align the main axis of inertia x—x of the axial fan wheel 1 in the rotation axis ξ—ξ of said axial fan wheel with tilting at ω=0.

Figure 4:
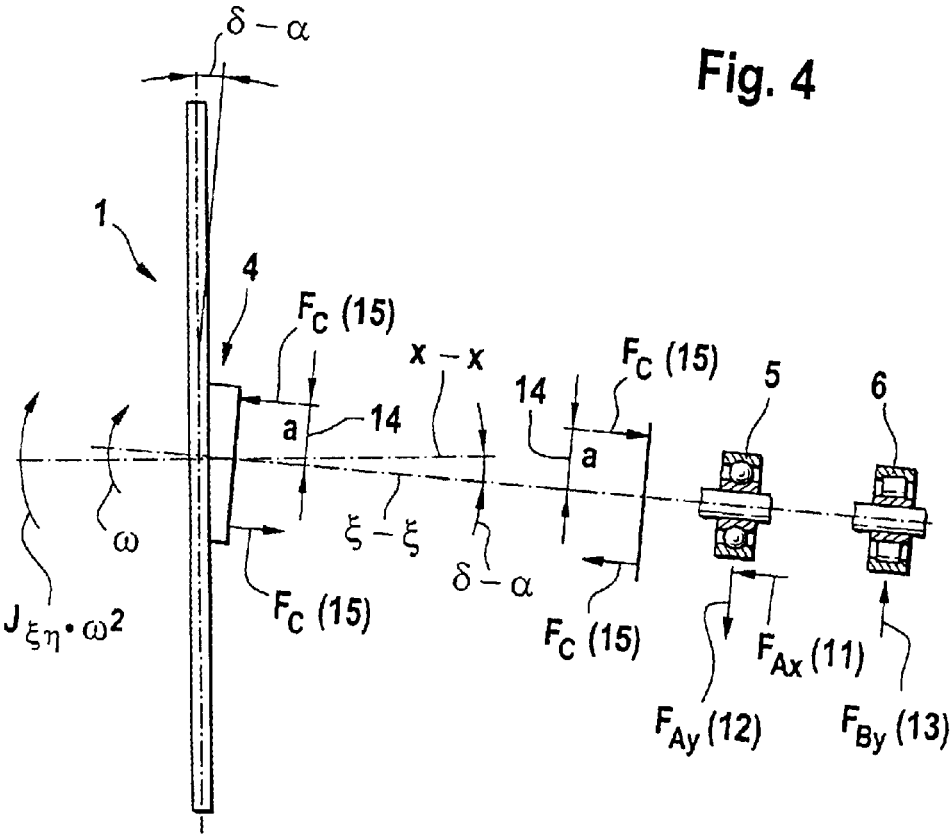
FIG. 4 shows the forces and moments acting on the substitute model of the axial fan.

FIG. 4 shows the forces and moments acting on the substitute model of the axial fan.

The inclination of the axial fan wheel 1 modelled as a rigid disk 1 that occurs at a given speed ω≠0 is characterized by δ minus α. To obtain re-alignment, that is, to make the main axis of inertia x—x coincide with the rotation axis ξ—ξ, the centrifugal moment $J_{\xi\eta}\cdot\omega^2$ is utilized by the soft connection of the hub region 5 to the rotation axis ξ—ξ as rotational speed increases. In order to obtain a return of the axial fan wheel 1 modelled as a rigid disk in the depiction according to FIG. 4 to an angular position in which the angle difference δ−α equals zero, a connection of the hub region 4 to the rotation axis ξ—ξ should be designed that is as flexurally soft as possible and enables a self-orientation of the axial fan wheel 1.

The moment relationship for the axial fan wheel 1 that occurs as far as the axial fan wheel 1 is concerned is:

$$\Sigma M=0,\ \text{that is,}\ J_{\xi\eta}\cdot\omega^2\cdot\omega^2=F_c\cdot a.$$

If this relationship is fulfilled, the axial fan wheel 1 rights itself in its rotation around the rotation axis ξ—ξ in such a manner that the rotation axis ξ—ξ and the main axis of inertia x—x of the axial fan wheel 1 coincide. The axial and radial forces acting on the bearings 5 and 6 of the rotation axis ξ—ξ through the axial fan wheel 1 are characterized with the reference numerals 11, 12 and 13 in the depiction according to FIG. 4.

Figure 5:
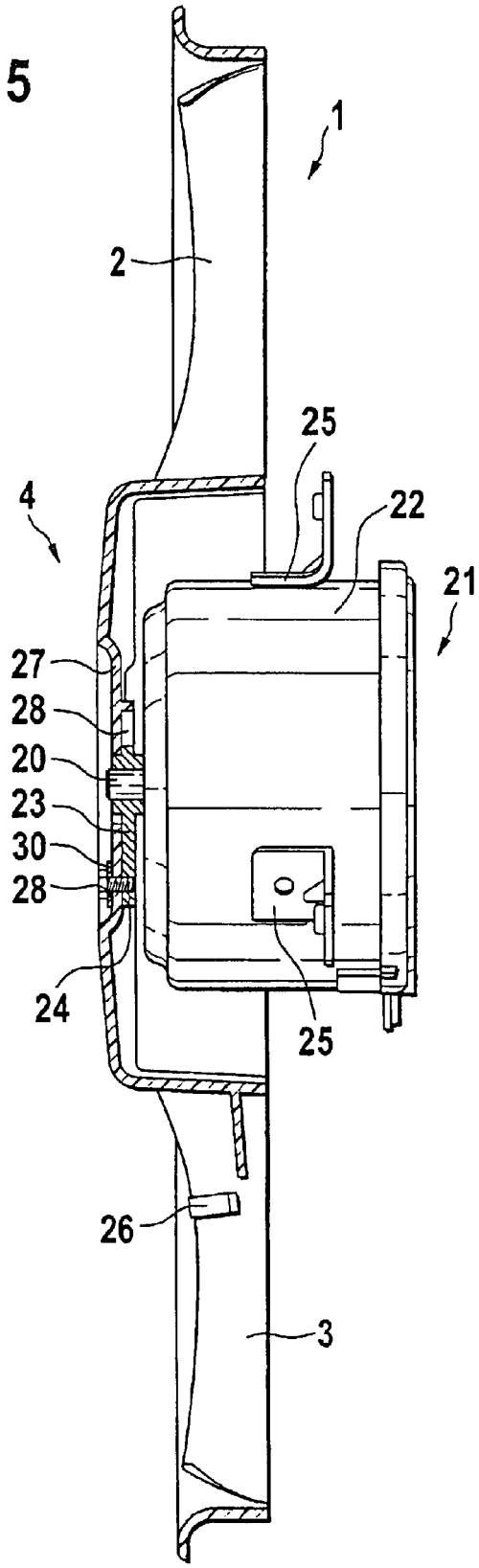
FIG. 5 is the side view of an axial fan with electrical drive.

The depiction according to FIG. 5 is the side view of an axial fan with electrical drive.

According to the side view in FIG. 5, the axial fan wheel 1 comprises a number of fan blades 2 and 3 in its outer circumferential region, which said fan blades are integrally molded on the circumference of a hub region 4. In the center of the hub region 4, the axial fan wheel 1 is interconnected with a driven shaft 20 of an electrical drive 21. The electrical drive 21 is accommodated in a housing 22 and partially extends into the pot-shaped hub region 4 of the axial fan wheel 1 in order to shorten the axial length of the fan arrangement according to the depiction in FIG. 5. A disk 23 composed of flexurally soft, elastic material can be mounted on the driven shaft 20 of the electrical drive 21, which said disk is interconnected with a region 27—that is turned inwardly in the shape of a plate or well—of the hub region 4 of the axial fan wheel 1. Fastening screws 24 serve to interconnect the elastic disk 23 mounted on the driven shaft 20 of the electrical drive 21 with the well-shaped hub plate 27 of the hub region 4. The fastening screws 24 can be equipped with spring elements 30 in order to increase the flexural softness of the connection between the elastic disk 23 and hub plate 27 in the hub region 4 of the axial fan wheel 1. The spring elements 30 can be provided on the fastening screws 24 either in the region of the hub plate 27 turned inwardly in the manner of a well, or between the fastening screws 24 and the elastic disk 23.

Retaining devices are labelled with reference numeral 25; they can be used to fasten the housing 22 of the electrical drive 21 to a radiator assembly in the engine compartment of a motor vehicle.

A balancing weight is labelled with reference numeral 26; it is accommodated on a fan blade 3 on the circumference of the hub region 4 of the axial fan wheel 1 according to the depiction in FIG. 5 in order to statically balance the axial fan wheel 1.

Hub and disk bores 28 are formed in the hub and disk at the connection of the hub plate 27—turned inward in the manner of a well—in the hub region 4 of the axial fan wheel 1 and the elastic disk 23, which said bores accommodate the fastening screws 24 with optional spring elements 30 accommodated on them. The hub bores 28 are arranged on a divided circle of hub bores 29, which is shown in FIG. 6 in greater detail.

Figure 6:
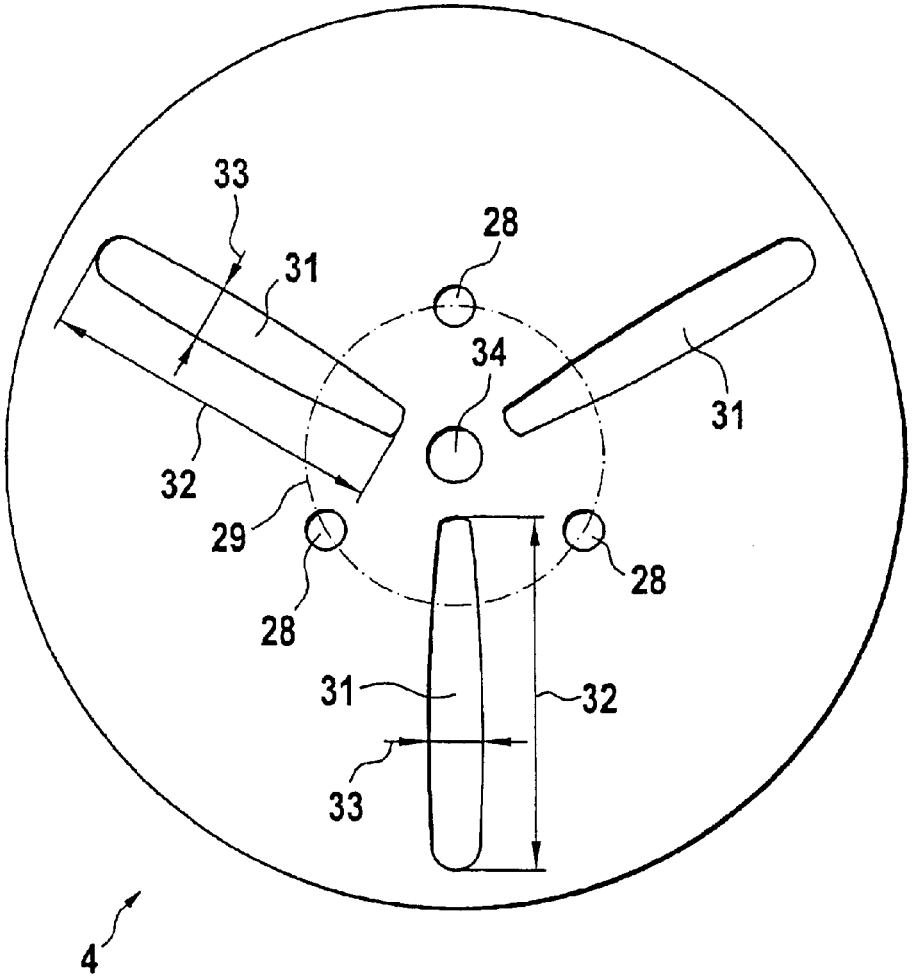
FIG. 6 is the top view of the hub of the axial fan wheel according to the depiction in FIG. 5.

The depiction according to FIG. 6 shows the top view of the hub of the axial fan wheel according to FIG. 5.

The pot-shaped hub region 4 of the axial fan wheel according to the depiction in FIG. 5 comprises slits 31 extending in the radial direction that are offset here by 120° relative to each other on the circumference of the hub region. The slits 31 are designed with a length 32 that exceeds the respective slit width 33 by a multifold amount. In addition to the radial slits 31 arranged here offset at a 120° angle relative to each other, the hub region 4 of an axial fan wheel 1 can also be developed with 4, 5, 6 or an even higher number of radial slits 31. Forming the radial slits 31 in the wall of the hub region 4 that lies in the plane of the drawing of the depiction according to FIG. 6 enables a self-alignment of the axial fan wheel 1 by the centrifugal moment $J_{\xi\eta}\cdot\omega^2$ to be achieved in which the main axis of inertia x—x of the axial fan wheel 1 coincides with its rotation axis ξ—ξ. Next to a formation of radial slits 31 in the hub region 4 of the axial fan wheel 1, the hub bores 28 in the hub region 4 mentioned hereinabove in conjunction with FIG. 5 can be formed on a divided circle of screw connections 29, the diameter of which is less than half the diameter of the hub region 4 of the axial fan wheel 1. The further the hub bores 2—only three of which are arranged on the divided circle of screw connections 29 in the depiction according to FIG. 6—are located in the direction of the bore 34 that is penetrated by the driven shaft 20 of the electrical drive 21, the greater the flexural softness that occurs in the hub region 4 of the axial fan wheel 1, and, when the axial fan wheel 1 rotates around the rotation axis ξ—ξ at angular velocity c, said flexural softness promotes self-alignment and compensation of tolerances of form and position of the axial fan wheel 1 produced using a plastic injection-molding procedure.

A further possibility for obtaining a flexurally soft connection of the hub region 4 with the driven shaft 20 of an electrical drive 21 is to reduce the material strength in the hub region 4 in the region of the hub plate 27 turned inwardly in the manner of a well. Furthermore, a flexurally softer connection of the hub region 4 to the driven shaft 20 of the electrical drive 21 can be obtained by forming spring elements on the spring elements 24 that interconnect the elastic disk 23 and the hub plate 27—turned inwardly in the manner of a well—of the hub region 4, which said spring elements produce spring moments $F_c\cdot a$ depending on the displacement that counteract the centrifugal moment $J_{\xi\eta}$ that increases as rotational speed increases. If the two moments mentioned hereinabove are in equilibrium, the axial fan wheel 1 is aligned in such a manner that its main axis of inertia x—x coincides with the rotation axis ξ—ξ, and no vibrations can be transmitted by means of structure-borne noise to other components in the engine compartment of a motor vehicle, or to the passenger compartment of a motor vehicle.

Figure 7:
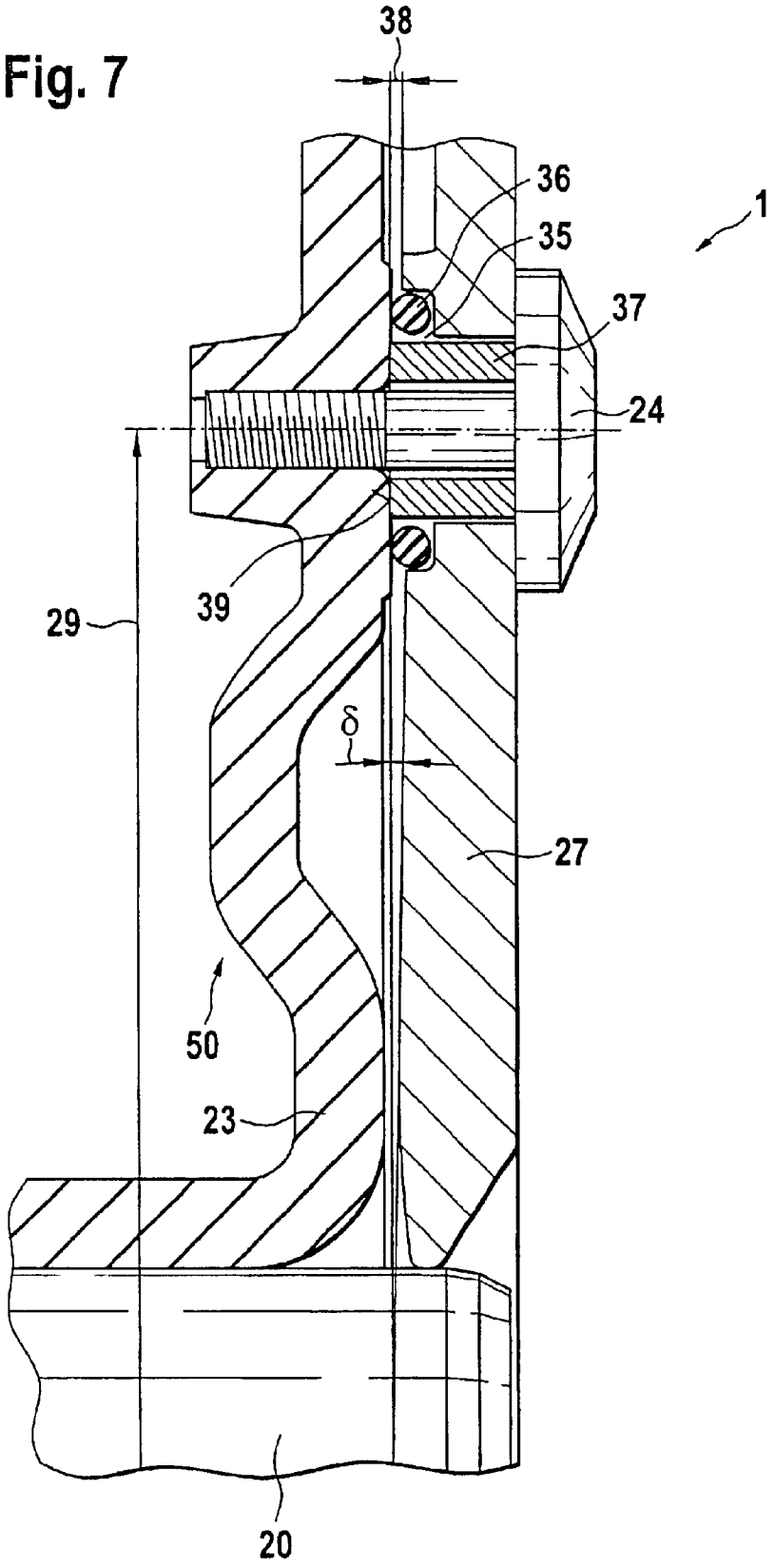
FIG. 7 shows a further exemplary embodiment of a flexurally soft mounting of an axial fan wheel on a drive.

FIG. 7 shows a further exemplary embodiment, according to the invention, of a flexurally soft mounting of an axial fan wheel on a drive.

According to the depiction in FIG. 7, an elastic driver 23 and a hub plate 27 of the axial fan wheel 1 interconnected with the elastic driver 23 are mounted on the armature shaft 20 of an electrical drive not shown here. In the exemplary embodiment according to FIG. 7, the elastic driver 23 is provided with a profile 50 configured in the shape of an "S" that extends on the elastic driver 23 in its radial direction. The hub plate 27 of the axial fan wheel 1 is screwed together via fastening screws 24 on fixing threads of the elastic driver 23 in the region of the divided circle of screw connections 29. A spacer bush 37 is installed between the screw heads of the fastening screws 24 and the transversely-extending end surface of the driver 23 composed of elastic material. Said spacer bush rests with a bearing surface 39 on the flat end face of the driver 23 composed of elastic material. A circumferential recess 35 is accommodated on the hub plate 27 in the region of the spacer bush 37, in which an elastic element is recessed. As depicted in FIG. 7, for example, the elastic element 36 can be accommodated as an O-ring that encircles the spacer bush 37. In its non-deformed state, that is, in its non-loaded state, the O-ring recessed in the circumferential recess 35 permits a displacement "s" that is identified in the depiction according to FIG. 7 with reference numeral 38. This means that the hub plate 27 of the axial fan wheel can move around the tilt angle δ sketched in FIG. 7 due to the fact that the spacer element 36 recessed in the recess 35 creates a flexurally soft connection between the elastic driver 23 and the hub plate 27 of the axial fan wheel 1.

Figure 8:
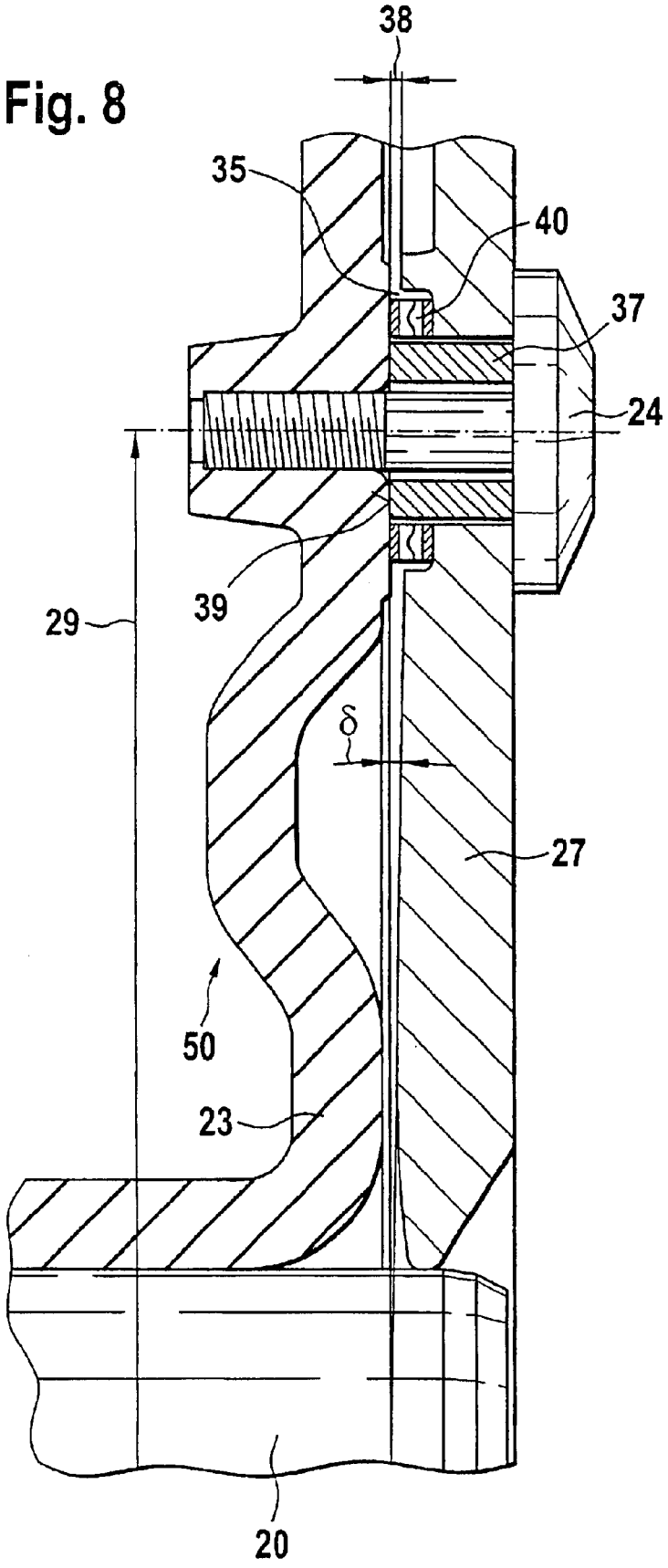
FIG. 8 shows a third exemplary embodiment of a flexurally soft coupling of an axial fan wheel to a drive.

FIG. 8 shows a third exemplary embodiment of a flexurally soft connection of an axial fan wheel to a drive.

The depiction according to FIG. 8 also shows a driver 23 composed of elastic material and provided with an S-shaped profile, and a hub plate 27 interconnected with said driver via fastening screws 24. In deviation from the exemplary embodiment shown in FIG. 7, the third exemplary embodiment shown according to FIG. 8, a corrugated washer 40 composed of metallic material is recessed in the circumferential recess 35 on the hub plate 27 of the axial fan wheel. The corrugated washer 30 composed of metallic material and recessed in the circumferential recess 35 also enables a flexurally soft connection of the hub plate 27 of the axial fan wheel 1 to the driver 23 composed of elastic material. The depiction according to FIG. 8 shows that a displacement path "s" exists as a result of the corrugated washer 40 shown in the resting state between the flat surfaces of the hub plate 27 and the elastic driver 23, which said displacement path is labelled with reference numeral 38 in the depiction according to FIG. 8, in analogous fashion to the depiction according to FIG. 7. By means of the displacement "s", it is ensured that the hub plate 27 with axial fan wheel 1 developed thereon can move by the amount represented by the angle δ, which ensures that the hub plate 27 can move relative to the elastic driver 23 mounted on the armature shaft 20. The fastening screws 24, with which the hub plate 27 of the axial fan wheel 1 is interconnected with the flat end face of the elastic driver 23, are arranged in the divided circle of screw connections 29.

Figure 9A:
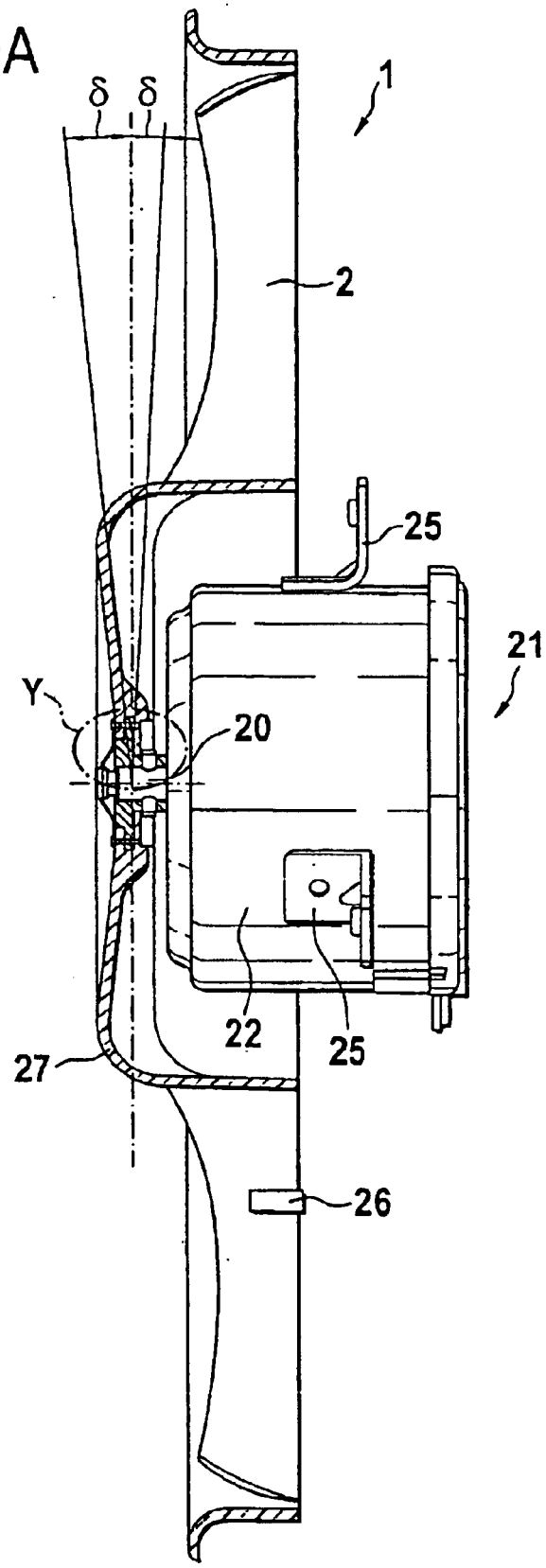
FIG. 9A shows a fourth exemplary embodiment of a flexurally soft coupling of an axial fan wheel to a drive with range of displacement.

FIG. 9A shows a fourth exemplary embodiment of a flexurally soft connection of an axial fan wheel on the drive with a range of displacement.

The axial fan wheel 1 according to the depiction in FIG. 9A is mounted on the armature shaft 20 of an electrical drive 21 with a bush element 42 installed therebetween. The electrical drive 21 is mounted on a structural element of a vehicle via retaining elements 25 shown here in a schematic representation. The axial fan wheel 1 comprises fan blades 2 in which balancing weights 26 can be located. The retaining elements 25 are situated on the housing 22 of the electrical drive 21 at an angle of 120° relative to each other, for example. The hub plate 27 of the axial fan wheel 1 partially surrounds the electrical drive 21. The region labeled with the letter Y in FIG. 9A is shown as an enlarged detail in the depiction according to FIG. 9B.

Figure 9B:
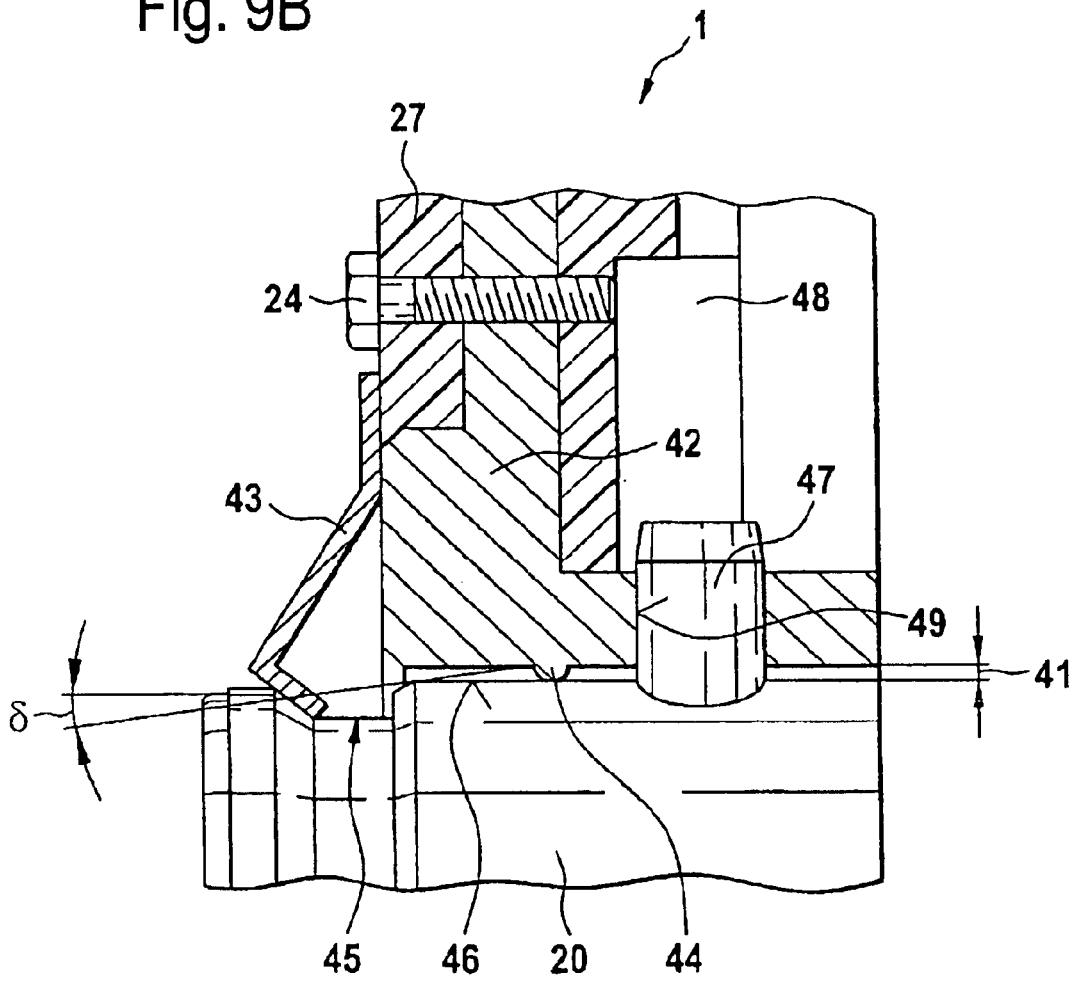
FIG. 9B shows the coupling point of axial fan wheel and drive according to the depiction in FIG. 9 as a detail shown in an enlarged view.

In the depiction according to FIG. 9B it is clear that a bush element 42 is accommodated in the region of a bearing area 46 of the armature shaft 20 of the electrical drive 21. The bush element 42 is pressed against a locating ring 47 by means of a tensioning element 43 also bearing against the armature shaft 20 in the region of an annular groove 45. The locating ring 47 completely encircles the armature shaft 20 of the electrical drive 21. The tensioning element 43, which can be designed as a clamping disk, for example, bears with a shoulder against a flank of an annular groove 45 developed in the armature shaft 20. while the shoulder of the tensioning element 43 extending further outward bears against the end face formed by the bush element 42 and the hub plate 27 of the axial fan wheel 1. The hub plate 27 and the bush element 42 are interconnected via fastening screws 24. The bush element 42 comprising a support 44 is placed by means of the tensioning element 43 in the axial direction against a bearing surface 49 on the locating ring 47. As a result, the bush element 42 is secured in the axial direction.

The armature shaft 20 of the electrical drive 21 comprises a bearing area 46 on which the support 44 of the bush element 42 rests. The support 44 represents a tilting point of the bush element 42 tiltable in the radial direction and secured on the armature shaft 20 in the axial direction. Due to the fact that the bush element 42 can move relative to the bearing area 46 of the armature shaft 20, an inclination of the hub plate 27—and, therefore, the axial fan wheel 1—mounted on the tiltably supported bush element 42 can take place within the range of the permitted tilting play. Dynamic imbalances that occur are automatically compensated by means of this seating of the bush element 42, acted upon by a tensioning element 43 when the armature shaft 20 of the electrical drive 21 rotates.

The required tilt angle can be calculated from the expected dynamic imbalance of the fan. This explained briefly with reference to an example calculation. In the case of a fan with 25000 $gmm^2$ expected dynamic imbalance, the soft tilt angle required can be calculated using the equation $$U_{dyn} = \frac{J_x - J_y}{2} \cdot 2\sin\delta$$

From this, it follows:

$$\delta = \frac{1}{2} \cdot \arcsin\left(\frac{2 \cdot U_{dyn}}{Jx - Jy}\right),$$

with a fan diameter of 390 mm and a fan weight of 463 g:

$$Jx - Jy = m\frac{r^2}{4} = 463\ \text{g}\frac{195^2\ \text{mm}^2}{4} = 4401 \cdot 10^3\ \text{gmm}^2$$

which results in:

$$\delta = \frac{1}{2} \cdot \arcsin\left(\frac{2 \cdot U_{dyn}}{Jx - Jy}\right) = \frac{1}{2} \cdot \arcsin\left(\frac{2 \cdot 25000\ \text{gmm}^2}{4401 \cdot 10^3\ \text{gmm}^2}\right)$$

The calculated angle of 0.32° corresponds to a soft displacement of s=50·sin 0.32°=0.28 mm, assuming a divided circle of screw connections 29 of 50 mm.

Based on this example calculation for the given example and assuming the stated data, the displacement path "s" labelled with reference numeral 38 is approximately 3/10 mm.

| List of Reference Numerals | |
|---|---|
| 1 | Axial fan wheel |
| 1' | Axial fan wheel in rotation |
| 2 | Fan blade |
| 3 | Fan blade |
| 4 | Hub region |
| 5 | Fixed bearing |
| 6 | Movable bearing |
| 7 | Center of gravity |
| 8 | Rotation axis coordinate system |
| 9 | Spring element |
| 10 | Spring element |
| x—x | Fan axis (main axis of inertia) |
| y—y | Fan vertical axis |
| ξ—ξ | Rotation axis of axial fan wheel |
| η—η | Tilt |
| $J_{\xi\eta} * \omega^2$ | Centrifugal moment |
| ω | Angular velocity |
| δ | Inclination at ω = 0 |
| α | Displacement at ω ≠ 0 |
| δ − α | Displacement difference |
| 11 | Axial force component fixed bearing 5 |
| 12 | Radial force component fixed bearing 5 |
| 13 | Radial force component movable bearing 6 |
| 14 | Lever arm a |
| 15 | Spring force $F_c$ |
| 20 | Armature shaft |
| 21 | Electrical drive |
| 22 | Housing |
| 23 | Elastic disk |
| 24 | Fastening screw |
| 25 | Retaining device |
| 26 | Balancing weight |
| 27 | Hub plate |
| 28 | Hub bore |
| 29 | Divided circle of screw connections |
| 30 | Spring element |
| 31 | Radial slit |
| 32 | Length of slit |
| 33 | Width of slit |
| 34 | Bore |
| 35 | Circumferential recess |
| 36 | Spacer element |
| 37 | Spacer bush |
| 38 | Displacement s |
| 39 | Bearing surface |
| 40 | Corrugated washer |
| 41 | Tilting play |
| 42 | Bush element |
| 43 | Tensioning element |
| 44 | Support |
| 45 | Annular groove |
| 46 | Bearing area |
| 47 | Locating ring |
| 48 | Annular space |
| 49 | Bearing surface of bush element |
| 50 | S-shaped driver profile |

What is claimed is:

1. An axial fan, comprising a hub region (4, 27) for connecting the axial fan with a driven shaft (20) of an electrical drive (21). whereby the axial fan is statically balanced by means of a balancing weight (26), wherein a flexurally soft connection is formed in the hub region (4, 27) between the axial fan wheel (1) and the driven shaft (20) of an electrical drive (21), and further comprising a driver (23) composed of elastic material and mounted on the driven shaft (20) of the electrical drive (21), wherein the flexurally soft connection comprises an interconnection, by mean of fastening screws, between the hub region (4, 27) having a plate-shaped hub recess (27) with openings (31 extending in a radial direction, and the driver (23).

2. The axial fan according to claim 1, wherein the length (32) of the openings (31) in the radial direction exceeds their width (33).

3. The axial fan according to claim 1, wherein the material strength of the axial fan wheel is reduced in the hub region (4, 27).

4. The axial fan according to claim 1, wherein said axial fan is manufactured according to the 2-component injection molding method, whereby the components are provided with flexurally soft properties in the hub region (4, 27) compared with the components integrally extruded in the vane region (2, 3).

5. The axial fan according to claim 1, wherein a divided circle of screw connections (29) is formed in the hub region (4, 27) having a diameter that is less than half the diameter of the hub region (4, 27) of the axial fan.

6. The axial fan according to claim 5, wherein the number of hub bores (28) on the divided circle of screw connections (29) does not exceed 3.

7. The axial fan according to claim 1, wherein spring elements (30) are associated with the fastening screws (24) of the hub region (4, 27) on the elastic driver (23).

8. The axial fan according to claim 7, wherein the spring elements (30) are situated between the fastening screws (24) and the hub region (4, 27).

9. The axial fan according to claim 7, wherein the spring elements (30) are provided between the elastic driver (23) and the fastening screws (24).

10. The axial fan according to claim 1, wherein the driver (23) is formed out of elastic material having an S-shaped profile (50).

11. The axial fan according to claim 10, wherein the S-shaped profile (50) extends in the radial direction on the driver (23).

12. The axial fan according to claim 7, wherein spacer bushes (37) are accommodated between the elastic driver (23) and the hub plate (27) of the axial fan.

13. The axial fan according to claim 12, wherein the spacer bushes (37) are held in a bearing surface (39) on the elastic driver (23) and are situated in the region of the divided circle of screw connections (29).

14. The axial fan according to claim 12, wherein elastic spacer elements (36, 40) encircled by recesses (35) in the hub plate (27) are associated with the spacer bushes (37).

15. The axial fan according to claim 14, wherein the spacer elements (36) are developed as O rings.

16. The axial fan according to claim 14, wherein the spacer elements (40) are created as wavy disks having spring action.

17. The axial fan according to claim 1, wherein the flexurally soft connection comprises a bush element (42) tiltably supported on the armature shaft (20), wherein the hub plate (27) of the axial fan (10) is mounted on the bush element (42).

18. The axial tan according to claim 17, wherein the bush element (42) is clamped, by means of a tensioning element, on the bearing area (46) of the armature shaft (20) against a locating ring (47).

19. The axial fan according to claim 17, wherein the bush element (42) comprises a support (44) enabling tilting play (41).

20. The axial fan according to claim 18, wherein the bush element (42), by means of an axially-clamping tensioning element (43), rests in an annular groove (45) of the armature shaft.

* * * * *